US006651979B2

(12) United States Patent
Shyu

(10) Patent No.: US 6,651,979 B2
(45) Date of Patent: Nov. 25, 2003

(54) LINK TYPE PAPER TRAY STRUCTURE

(75) Inventor: Devon Shyu, Hsin-Chu (TW)

(73) Assignee: Avision Inc. (TW)

( * ) Notice: Subject to any disclaimer, the term of this patent is extended or adjusted under 35 U.S.C. 154(b) by 27 days.

(21) Appl. No.: 10/040,089

(22) Filed: Jan. 8, 2002

(65) Prior Publication Data

US 2003/0001331 A1 Jan. 2, 2003

(30) Foreign Application Priority Data

Jul. 2, 2001 (TW) ..... 90211042 U

(51) Int. Cl.[7] ..... B65H 31/20
(52) U.S. Cl. ..... 271/171
(58) Field of Search ..... 221/121, 144, 221/223; B65H 31/20, 1/00

(56) References Cited

U.S. PATENT DOCUMENTS 4,174,103 A * 11/1979 Back et al. ..... 271/171
5,655,764 A * 8/1997 Ota et al. ..... 271/171
5,881,337 A * 3/1999 Higashikawa et al. ..... 399/82
5,972,702 A * 10/1999 Beier et al. ..... 435/325

FOREIGN PATENT DOCUMENTS

JP 1-226652 * 9/1989 ..... B65H/9/06
JP 6-92476 * 4/1994 ..... B65H/1/04

* cited by examiner

*Primary Examiner*—Donald P. Walsh
*Assistant Examiner*—Kenneth W Bower
(74) *Attorney, Agent, or Firm*—Charles E. Baxley

(57) ABSTRACT

A link type paper tray structure includes a base, two movable guides, and a link mechanism. The base is provided for receiving paper. The link mechanism is mounted on the base. The link mechanism may be used to control movable guides mounted on the base to move reciprocally. Thus, the paper tray has a lower cost of fabrication, may efficiently reduce noise during use, and may facilitating operation.

5 Claims, 8 Drawing Sheets

LINK TYPE PAPER TRAY STRUCTURE

BACKGROUND OF THE INVENTION

1. Field of the Invention

The present invention relates to a link type paper tray structure for receiving paper to be automatically conveyed.

2. Description of the Related Art

An ADF type device, such as a scanner, a printer or a photocopying machine, is provided with a paper tray in which paper can be placed. By the automatic paper feeding effect of the above-mentioned device, the paper on the paper tray may be serially sent to the scanner, printer or photocopying machine.

Referring to FIGS. 8 and 9, a paper tray 10 includes a base 11 for paper to be placed. The base 11 has an upper surface 12. The upper surface 12 is provided with a first movable guide 13 and a second movable guide 14. The second movable guide 14 may be moved relative to the first movable guide 13.

The lower surface 15 of the base 11 is provided with a rotatable gear 16. A first rack 17 is mounted on the lower surface 15 of the base 11, and is combined with the first movable guide 13 to engage the gear 16. A second rack 18 is mounted on the lower surface 15 of the base 11, and is combined with the second movable guide 14 to engage the gear 16. The first rack 17 and the second rack 18 respectively mesh with the opposite two sides of the gear 16.

In use, the user has to drive either one of the first movable guide 13 and the second movable guide 14, or to drive both of the first movable guide 13 and the second movable guide 14, so that the first movable guide 13 and the second movable guide 14 are moved toward each other or opposite to each other, so as to adjust the width between the first movable guide 13 and the second movable guide 14, thereby facilitating the placement of the paper (not shown) therebetween.

The adjustment action of the first movable guide 13 and the second movable guide 14 is achieved by the relative movement between the first rack 17, the second rack 18 and the gear 16. At this time, contact of the first rack 17 and the second rack 18 with the gear 16 will produce apparent sound due to friction, thereby creating larger noise. In addition, when the first movable guide 13 or the second movable guide 14 is driven, the contact force of the first movable guide 13 or the second movable guide 14 with the base 11 is increased, so that the driving action is not smooth, thereby causing inconvenience of operation.

In addition, the first movable guide 13 and the first rack 17 are made of plastic material. Thus, after combination, the connection position will form melted points 19 in a melted manner, so that the first movable guide 13 may be combined with the first rack 17. Similarly, the connection position of the second movable guide 14 and the second rack 18 will form melted points 21, 50 that the second movable guide 14 may be combined with the second rack 18. Thus, the combined and melted manufacturing manner is more inconvenient apparently, thereby relatively increasing cost of fabrication.

SUMMARY OF THE INVENTION

The primary objective of the present invention is to provide a link type paper tray structure including at least one movable guide mounted on a base, and a link mechanism connected with the movable guide. The movable guide may be moved by operating the link mechanism. Thus, mounting of the elements may be simplified, so that the fabrication is more simpler, thereby decreasing cost of fabrication. In addition, hit or friction between the elements may be reduced, thereby reducing noise during use and facilitating operation of the user.

Further benefits and advantages of the present invention will become apparent after a careful reading of the detailed description with appropriate reference to the accompanying drawings.

DETAILED DESCRIPTION OF THE PREFERRED EMBODIMENT OF THE INVENTION

Figure 1:
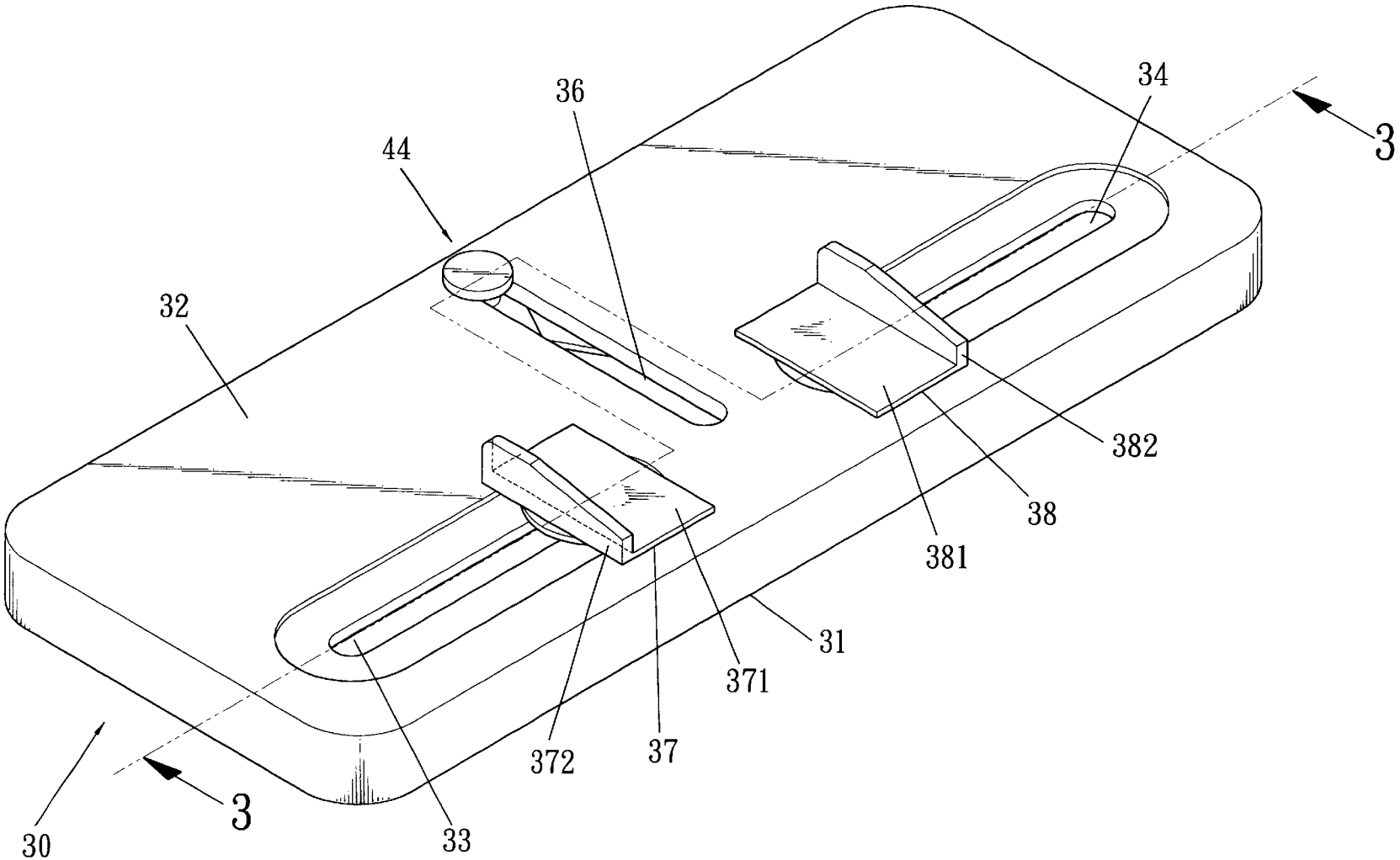
FIG. 1 is a pictorial view of a link type paper tray structure in accordance with one embodiment of the present invention.
Figure 2:
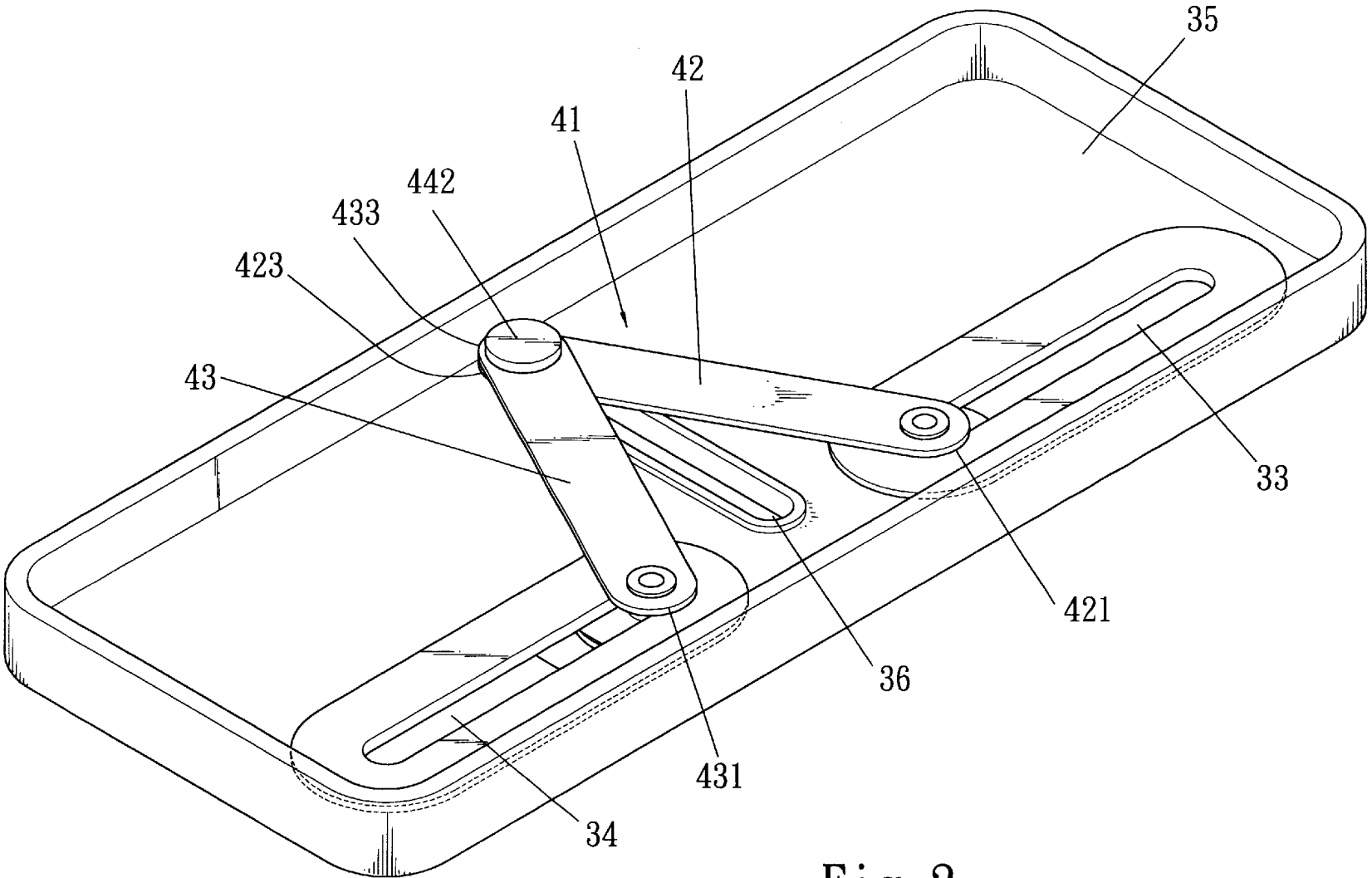
FIG. 2 is a bottom pictorial view of a link type paper tray structure in accordance with the present invention.

Referring to FIGS. 1 and 2, a paper tray 30 is provided for receiving paper. The paper tray 30 is used in a device such as a scanner, a printer or a photocopying machine.

The paper tray 30 includes a base 31 whose upper surface 32 is formed with a first slot 33 and a second slot 34 which are opposite to each other. The first slot 33 and the second slot 34 are extended from the upper surface 32 to the lower surface 35. The upper surface 32 is formed with a slide slot 36 which is located between the first slot 33 and the second slot 34. The slide slot 36 is extended from the upper surface 32 to the lower surface 35.

Figure 3:
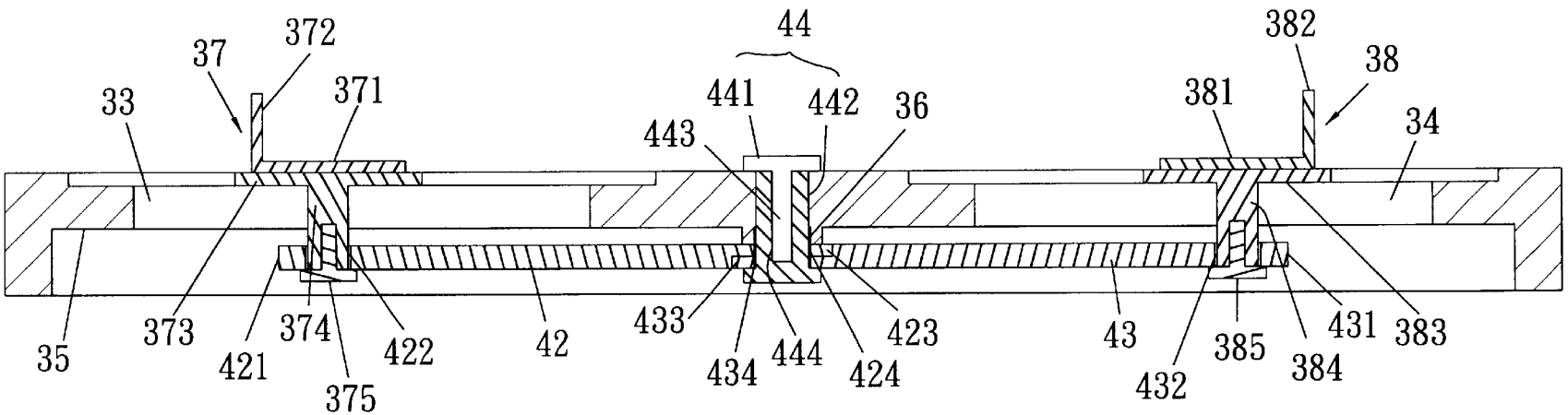
FIG. 3 is a cross-sectional view of the link type paper tray structure along line 3—3 as shown in FIG. 1.

Referring to FIGS. 1 and 3, the paper tray 30 includes a first movable guide 37 and a second movable guide 38. The first movable guide 37 has a support face 371 and a rest face 372. The rest face 372 is vertical to the support face 371. The bottom face 373 of the support face 371 is protruded with a connecting column 374. Similarly, The second movable guide 38 has a support face 381 and a rest face 382. The rest face 382 is vertical to the support face 381. The bottom face 383 of the support face 381 is protruded with a connecting column 384.

The connecting column 374 of the first movable guide 37 extends through the first slot 33, and protrudes from the lower surface 35 of the base 31. The connecting column 384 of the second movable guide 38 also extends through the second slot 34, and protrudes from the lower surface 35 of the base 31. The rest face 372 of the first movable guide 37 is opposite to the rest face 382 of the second movable guide 38.

Referring to FIGS. 2 and 3, the lower surface 35 of the paper tray 30 is provided with a link mechanism 41. The link mechanism 41 includes a first link 42 and a second link 43, and an operation bar 44 for operating the first link 42 and the second link 43.

The first link 42 has a first end 421 formed with a connecting hole 422, and a second end 423 formed with a fitting hole 424. The connecting column 374 of the first movable guide 37 extends through the connecting hole 422 of the first link 42, and a plug 375 is mounted on the connecting column 374, so that the first link 42 is combined with the first movable guide 37.

The second link 43 has a first end 431 formed with a connecting hole 432, and a second end 433 formed with a fitting hole 434. The connecting column 384 of the second movable guide 38 extends through the connecting hole 434 of the second link 43, and a plug 385 is mounted on the connecting column 384, so that the second link 43 is combined with the second movable guide 38.

The second end 423 of the first link 42 overlaps the second end 433 of the first link 43, and the fitting hole 424 of the first link 42 is opposite to the fitting hole 434 of the first link 43.

The operation bar 44 consists of a first plug 441 and a second plug 442. The first plug 441 has a protruding column 443, and the second plug 442 has a mounting hole 444.

The protruding column 443 of the first plug 441 passes through the slide slot 36 of the base 31 and the opposite fitting holes 424 and 434, and is combined with the mounting hole 444 of the second plug 442.

Figure 4:
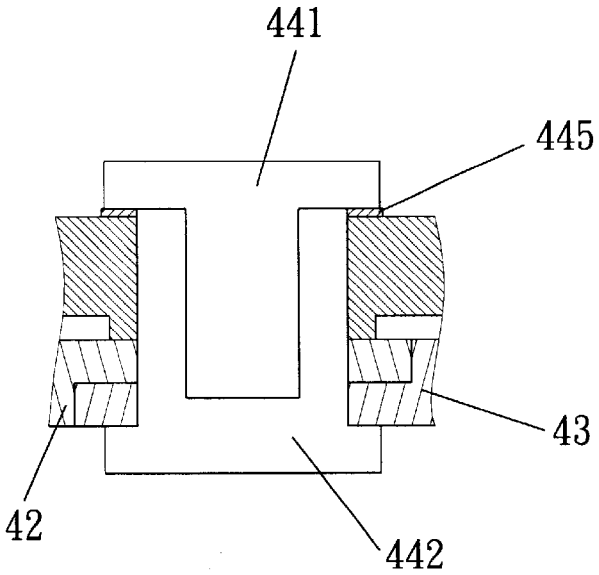
FIG. 4 is a cross-sectional view of the link type paper tray structure in accordance with another embodiment of the present invention.

The first plug 441 and the second plug 442 may be combined and positioned by fitting. As shown in FIG. 4, an elastic washer 445 is mounted between the first plug 441 and the second plug 442. Thus, the tension between the first plug 441, the second plug 442, the first link 42 and the second link 43 may be enhanced.

Figure 5:
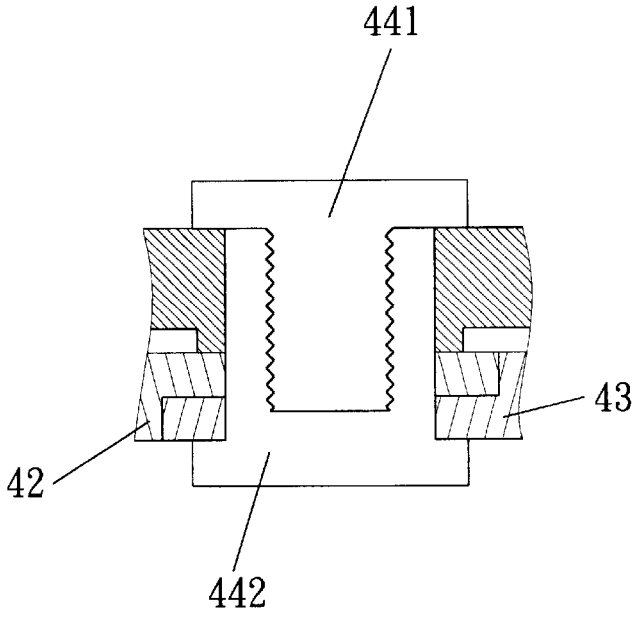
FIG. 5 is a cross-sectional view of the link type paper tray structure in accordance with still another embodiment of the present invention.

Referring to FIG. 5, the first plug 441 and the second plug 442 may be combined in a screwing manner. The operation bar includes two plugs 441, 442 that have a threaded protruding column and a threaded hole respectively. The threaded protruding column is threadedly engaged with the threaded hole. Thus, the tension between the first plug 441, the second plug 442, the first link 42 and the second link 43 may be adjusted by the screwing extent.

The mounting manner of the first plug 441 and the second plug 442 may be employed to the mounting manner of the connecting columns 374 and 384 and the plugs 375 and 385.

Figure 6:
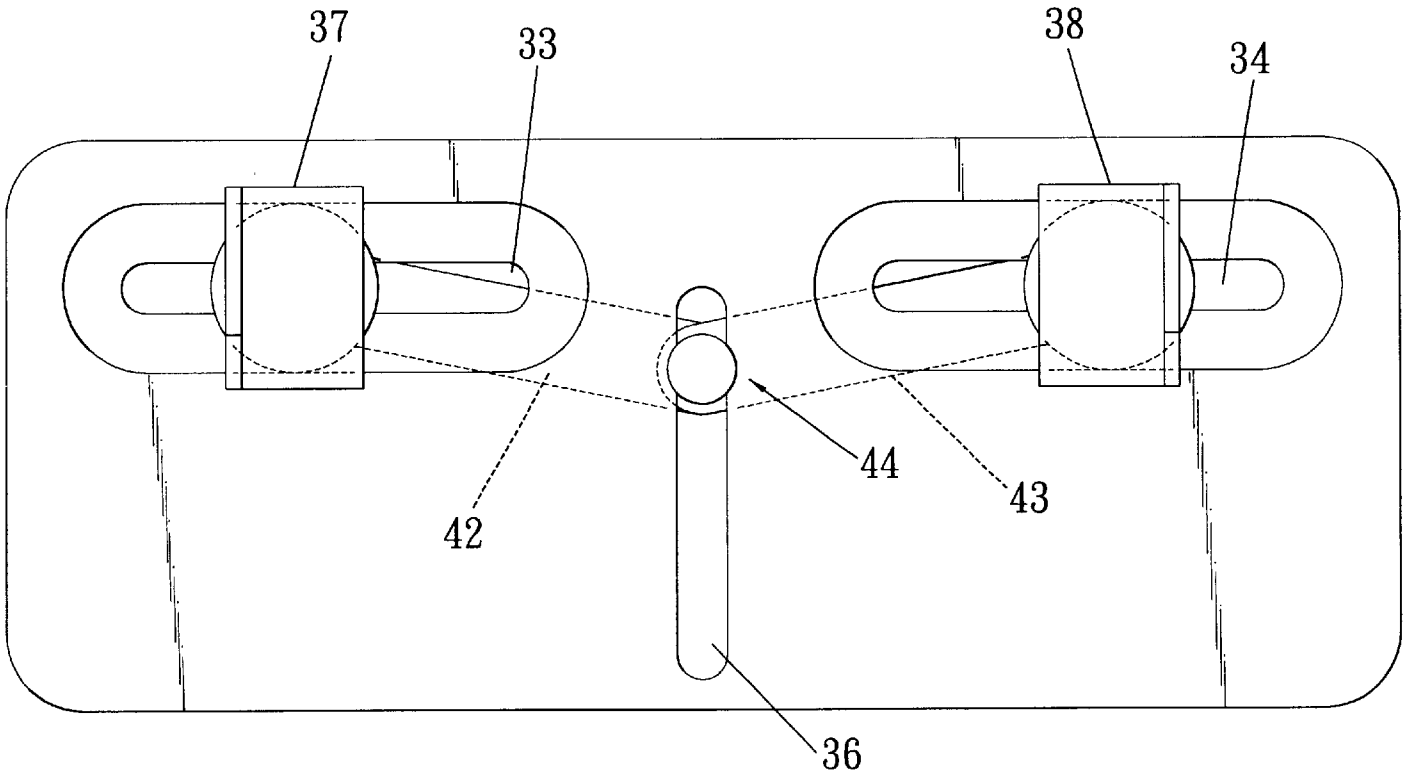
FIG. 6 is a schematic operational view of the link type paper tray structure in accordance with the present invention.
Figure 7:
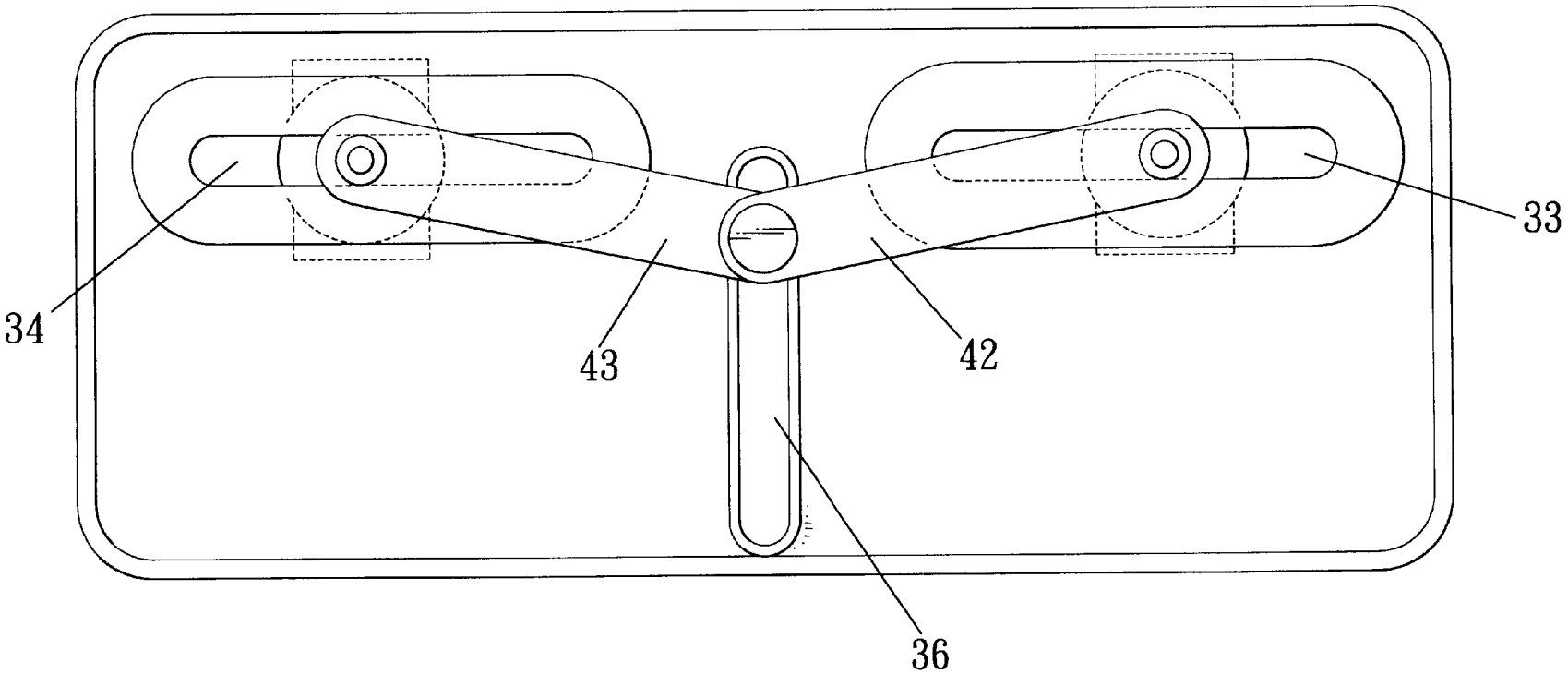
FIG. 7 is a schematic view of the link type paper tray structure as shown in FIG. 6.
Figure 8:
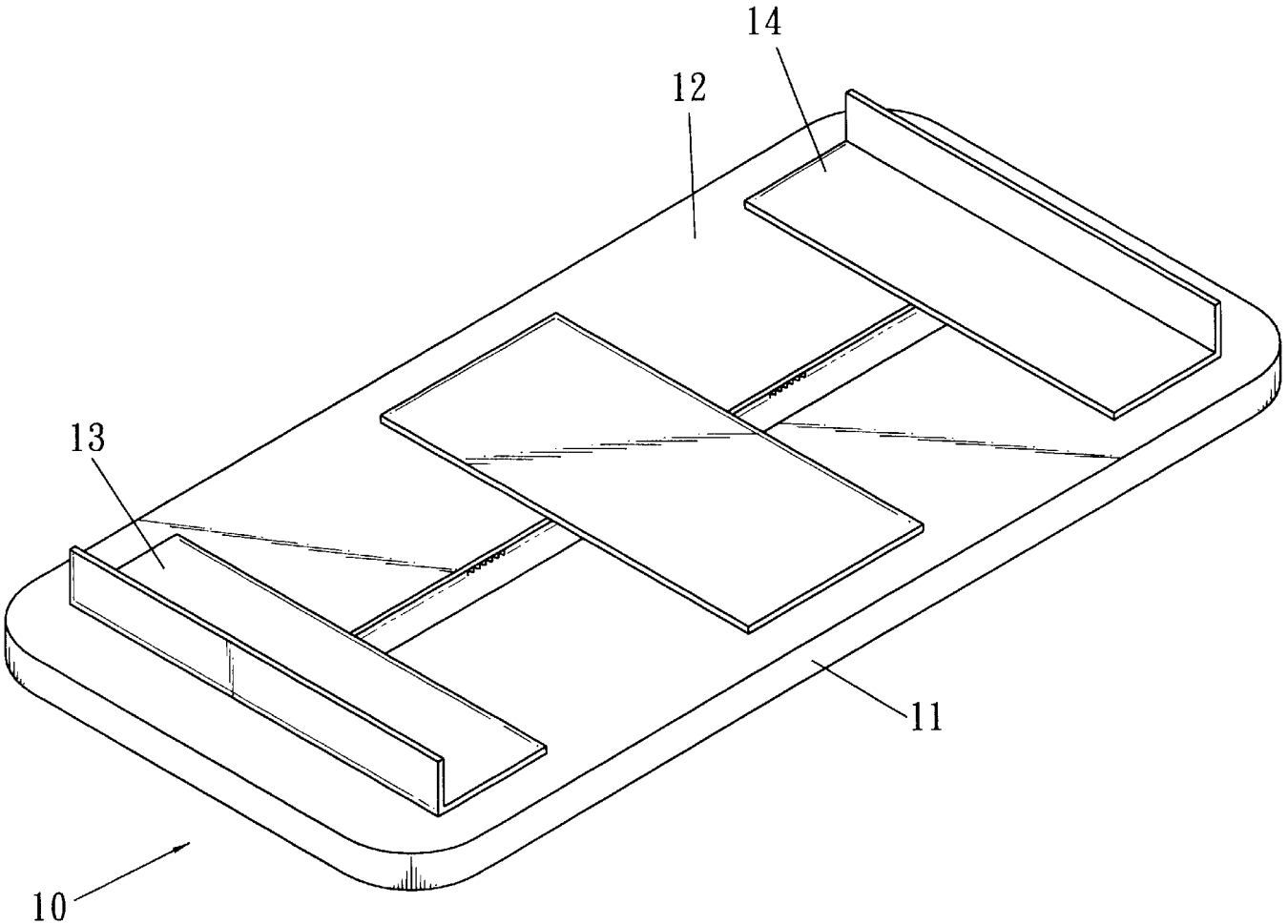
Fig. 8 PRIOR ART
FIG. 8 is a pictorial view of a conventional paper tray in accordance with the prior art.
Figure 9:
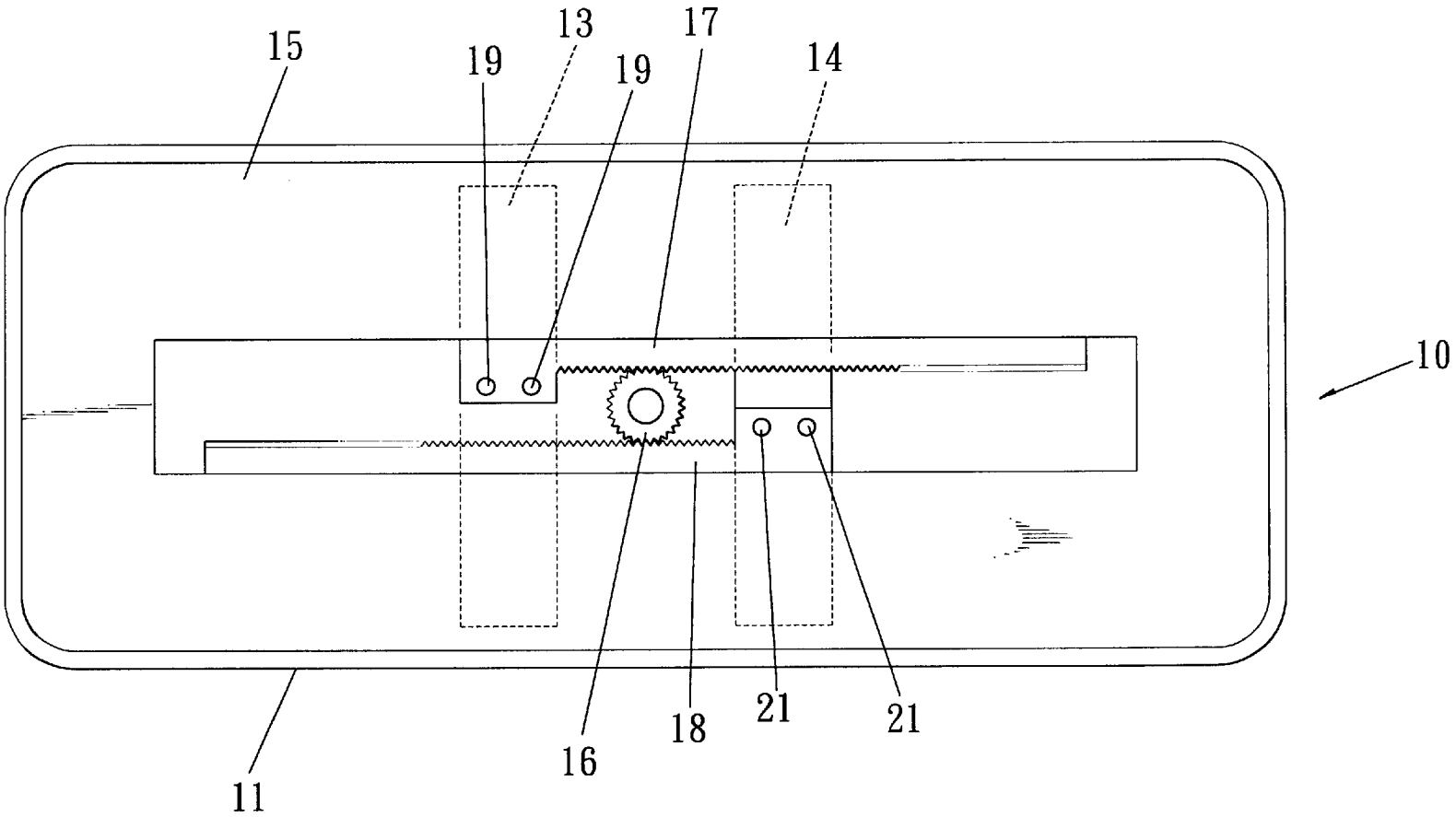
Fig. 9 PRIOR ART
FIG. 9 is a bottom plan view of the conventional paper tray in accordance with the prior art.

Referring to FIGS. 6 and 7, when the user drives the operation bar 44 to move along the slide slot 36, the first link 42 and the second link 43 may be moved simultaneously, so that the first movable guide 37 connected with the first link 42 may be moved along the first slot 33, and the second movable guide 38 connected with the second link 43 may be moved along the second slot 34. Thus, the first movable guide 37 and the second movable guide 38 may be moved toward each other or opposite to each other. Thus, the distance between the first movable guide 37 and the second movable guide 38 may be adjusted, thereby satisfying the size of the paper (not shown) and facilitating placing the paper.

The first link 42 and the second link 43 of the link mechanism 41 are directly connected with the first movable guide 37 and the second movable guide 38, and the first link 42 and the second link 43 are also connected with each other, so that mounting between each element does not need an additional working action. Thus, for fabrication, the cost required for working may be decreased.

In addition, the first movable guide 37, the second movable guide 38, the first link 42 and the second link 43 have been connected and combined. In operation, the user only needs to drive the operation bar 44 to adjust the position of the first movable guide 37 and the second movable guide 38, 50 that the operation is easy. Further, when the first link 42 and the second link 43 move the first movable guide 37 and the second movable guide 38, the first link 42, the second link 43, the first movable guide 37 and the second movable guide 38 will not hit each other. Thus, the sound created during use may be reduced efficiently, thereby greatly reducing noise in use.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A link type paper tray structure, comprising:

a base for receiving paper and having a slide slot;

two movable guides, oppositely mounted on said base; and a link mechanism including two links and an operation bar, said link mechanism mounted on said base, each link respectively connected with each movable guide and said operation bar connected to a connection of said two links, said operation bar of said link mechanism movably engaged with the slide slot, said link mechanism driving said two movable guides to move on said base toward each other or opposite to each other, thereby adjusting a relative position of said two movable guides.

2. The link type paper tray structure in accordance with claim 1, wherein said base is formed with two opposite slots for mounting said two movable guides and for retaining moving directions of said two movable guides.

3. The link type paper tray structure in accordance with claim 1, wherein said operation bar includes two plugs that have a protruding column and a mounting hole respectively, said protruding column being fitted in said mounting hole.

4. The link type paper tray structure in accordance with claim 1, wherein said operation bar includes two plugs that have a threaded protruding column and a threaded hole respectively, said threaded protruding column threadedly engaged with said threaded hole.

5. The link type paper tray structure in accordance with claim 1, wherein said operation bar includes two plugs that are mounted with each other, and an elastic washer is mounted between said two plugs.

* * * * *